US007596883B2

(12) United States Patent
Kameishi

(10) Patent No.: US 7,596,883 B2
(45) Date of Patent: Oct. 6, 2009

(54) HAND DRYING APPARATUS

(75) Inventor: Keiji Kameishi, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 255 days.

(21) Appl. No.: 10/585,143

(22) PCT Filed: Aug. 3, 2005

(86) PCT No.: PCT/JP2005/014226

§ 371 (c)(1),
(2), (4) Date: Jun. 30, 2006

(87) PCT Pub. No.: WO2007/015297

PCT Pub. Date: Feb. 8, 2007

(65) Prior Publication Data

US 2007/0144034 A1 Jun. 28, 2007

(51) Int. Cl.
*F26B 19/00* (2006.01)

(52) U.S. Cl. ..... 34/90; 34/60; 34/202; 34/218; 392/381; 250/432 R

(58) Field of Classification Search ..... 34/60, 34/90, 201, 202, 218; 392/381; 250/432 R
See application file for complete search history.

(56) References Cited

U.S. PATENT DOCUMENTS 1,918,927 A * 7/1933 Otto ..... 34/202
2,440,157 A * 4/1948 Rousseau ..... 34/229
2,606,274 A * 8/1952 Spierer ..... 392/381
2,853,592 A * 9/1958 Gravet ..... 422/243
2,991,560 A * 7/1961 Cota ..... 34/87
3,006,079 A * 10/1961 Jepson ..... 34/99
3,131,281 A * 4/1964 Jepson ..... 392/383
3,305,937 A * 2/1967 Gutwirth et al. ..... 34/423
3,305,938 A * 2/1967 Goldstein ..... 34/546
3,744,149 A * 7/1973 Helbling ..... 34/202
3,766,397 A * 10/1973 Rockson ..... 250/432 R
3,900,959 A * 8/1975 Breschi et al. ..... 34/639
3,970,093 A * 7/1976 Lardenois ..... 132/271
4,395,830 A * 8/1983 Lockwood ..... 34/365
4,893,741 A * 1/1990 Heinzmann ..... 242/615
4,999,927 A * 3/1991 Durst et al. ..... 34/448
5,009,016 A * 4/1991 LePisto et al. ..... 34/421
5,146,695 A * 9/1992 Yang ..... 34/90
5,272,781 A * 12/1993 Bastin et al. ..... 8/158
5,459,944 A 10/1995 Tatsutani et al.

(Continued)

FOREIGN PATENT DOCUMENTS

JP 3026222 * 2/1991

(Continued)

*Primary Examiner*—Stephen M. Gravini
(74) *Attorney, Agent, or Firm*—Buchanan Ingersoll & Rooney PC

(57) ABSTRACT

In a hand drying apparatus, a first air opening and a second air opening are arranged on opposing surfaces. The first air opening is displaced towards an interior of the hollow portion, for inserting wet hand, with respect to the second air opening such that axes of air jets output from the first air opening and the second air opening do not collide. Moreover, a surface that receives the air jet from an air opening on opposing surface is inclined toward the interior of the hollow portion.

10 Claims, 8 Drawing Sheets

U.S. PATENT DOCUMENTS

| | | | | |
|---|---|---|---|---|
| 5,749,156 | A * | 5/1998 | Mokler | 34/105 |
| 6,038,786 | A * | 3/2000 | Aisenberg et al. | 34/267 |
| 6,185,838 | B1 * | 2/2001 | Moore | 34/202 |
| 6,513,263 | B2 * | 2/2003 | Turcotte | 34/456 |
| 6,694,639 | B2 * | 2/2004 | Hanaya | 34/115 |
| 7,036,242 | B2 * | 5/2006 | Komulainen et al. | 34/117 |
| 7,039,301 | B1 * | 5/2006 | Aisenberg et al. | 392/380 |
| 7,437,833 | B2 * | 10/2008 | Sato et al. | 34/90 |
| 2002/0040535 | A1 * | 4/2002 | Turcotte | 34/117 |
| 2003/0019125 | A1 * | 1/2003 | Hanaya | 34/114 |
| 2004/0000067 | A1 * | 1/2004 | Baumann | 34/90 |
| 2004/0049940 | A1 * | 3/2004 | Komulainen et al. | 34/114 |
| 2006/0000110 | A1 * | 1/2006 | Aisenberg et al. | 34/443 |
| 2007/0144034 | A1 * | 6/2007 | Kameishi | 34/523 |
| 2008/0209760 | A1 * | 9/2008 | French et al. | 34/585 |
| 2008/0216342 | A1 * | 9/2008 | Kameishi et al. | 34/202 |
| 2008/0216343 | A1 * | 9/2008 | Churchill et al. | 34/202 |
| 2008/0216344 | A1 * | 9/2008 | Churchill et al. | 34/202 |
| 2008/0222910 | A1 * | 9/2008 | Churchill et al. | 34/202 |
| 2008/0273866 | A1 * | 11/2008 | Itoigawa et al. | 392/384 |
| 2008/0301970 | A1 * | 12/2008 | Hackwell et al. | 34/202 |
| 2008/0307667 | A1 * | 12/2008 | Ikemizu | 34/132 |
| 2008/0313918 | A1 * | 12/2008 | Dyson et al. | 34/202 |
| 2009/0034946 | A1 * | 2/2009 | Caine et al. | 392/380 |
| 2009/0113746 | A1 * | 5/2009 | Churchill et al. | 34/202 |
| 2009/0113748 | A1 * | 5/2009 | Dyson et al. | 34/232 |
| 2009/0119942 | A1 * | 5/2009 | Aisenberg et al. | 34/418 |
| 2009/0154907 | A9 * | 6/2009 | Itoigawa et al. | 392/384 |

FOREIGN PATENT DOCUMENTS

| | | | |
|---|---|---|---|
| JP | 6-62977 | * | 3/1994 |
| JP | 9-215630 | | 8/1997 |
| JP | 11-178742 | | 7/1999 |
| JP | 2001-190446 | | 7/2001 |
| JP | 2001-346715 | | 12/2001 |
| JP | 2002-136448 | | 5/2002 |
| JP | 2004-254989 | * | 9/2004 |
| JP | 2004-261510 | * | 9/2004 |

* cited by examiner

HAND DRYING APPARATUS

TECHNICAL FIELD

The present invention relates to a hand drying apparatus to be used to hygienically blow-dry wet hands after they are washed.

BACKGROUND ART

In a conventional hand drying apparatus (see Patent document 1), an opening leading to a hand drying chamber is provided at the upper portion of the main frame. A blowing unit housed inside the main frame connects at least three air outlets through a plurality of nozzles. All the nozzles are connected to a common air duct. A heating unit is provided inside the air duct. The air outlets in the hand drying chamber do not face each other and the hand drying chamber has enough room for rubbing the hands together. The bottom of the hand drying chamber has a drain port. The lower portion of the main frame has a control unit and a detecting unit that detects when a hand is inserted in the hand drying chamber.

Patent Document 1: Japanese Patent Publication No. 2001-346715 (Fourth paragraph, FIG. 1).

DISCLOSURE OF INVENTION

Problem to be Solved by the Invention

However, in the conventional hand drying apparatus, the gust of air coming out of the three air outlets collide with one another, causing turbulence, and noise resulting from the turbulence.

It is an object of the present invention to provide a hand drying apparatus that produces subdued noise.

Means for Solving Problem

To solve the above problems and to achieve the objects, according to an aspect of the present invention, a hand drying apparatus includes a first nozzle arranged on a first inner surface of a hand insertion chamber and configured to blow a first air jet towards a second inner surface of the hand insertion chamber; and a second nozzle arranged on the second inner surface and configured to blow a second air jet toward the first inner surface, wherein one nozzle is displaced towards an interior of the hand insertion chamber with respect to other nozzle such that axes of the first air jet and the second air jet do not collide, and a portion of an inner surface, on which the one nozzle that is displaced toward the interior is arranged, of the hand insertion chamber near the one nozzle that receives an air jet from the other nozzle is inclined towards the interior of the hand insertion chamber.

Effect of the Invention

According to the hand drying apparatuses of the embodiments, air jets do not collide with each other. Hence, an efficient and low-noise hand drying apparatus can be realized.

EXPLANATIONS OF LETTERS OR NUMERALS

Figure 1:
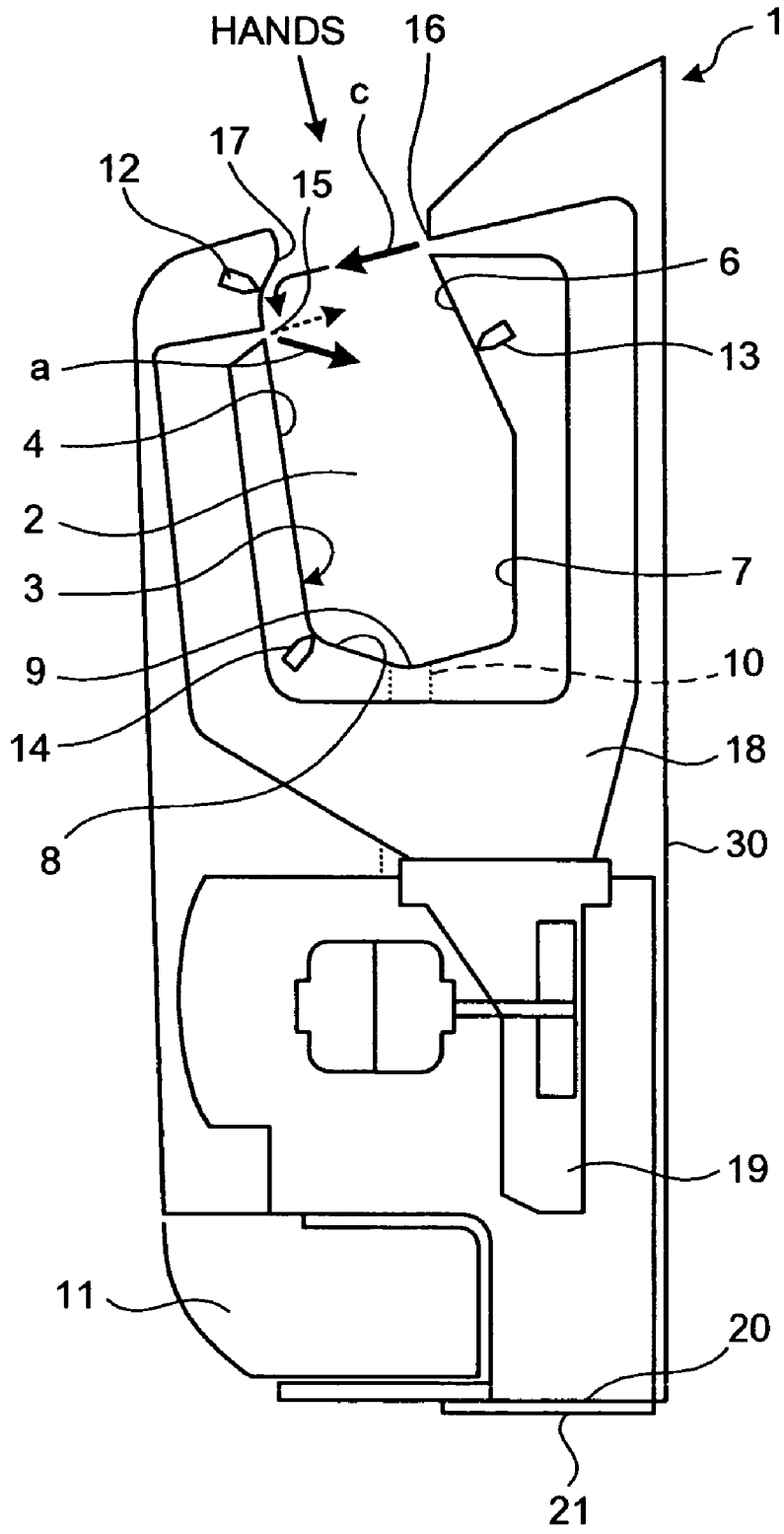
FIG. 1 is a vertical section of a hand drying apparatus according to a first embodiment of the present invention.

1 Hand drying apparatus
2 Hand insertion chamber
4 and 22 First inner surface
6 and 25 Second inner surface
15 First nozzle
16 Second nozzle
a First air jet
$a_4$ First air jet axis
c Second air jet
$c_4$ Second air jet axis

BEST MODE(S) FOR CARRYING OUT THE INVENTION

Exemplary embodiments of the hand drying apparatus according to the present invention are explained next with reference to the accompanying drawings. The present invention is not limited to the embodiments described here.

First Embodiment

Figure 2:
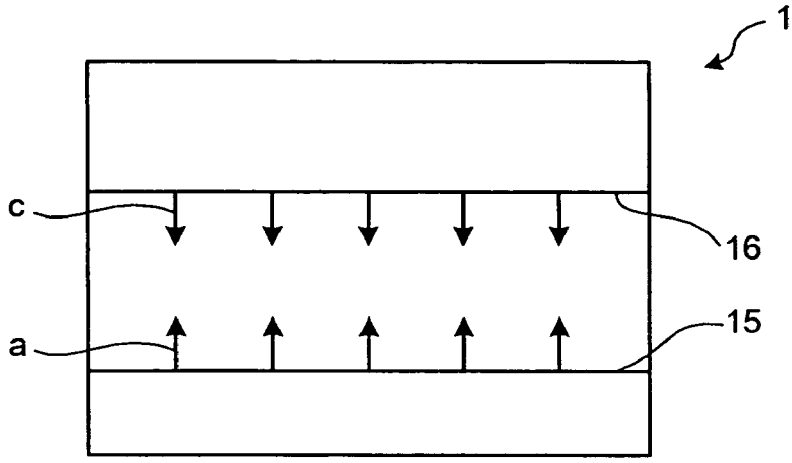
FIG. 2 is a top view of FIG. 1.
Figure 3:
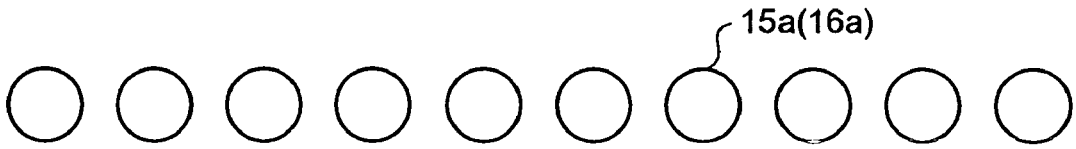
FIG. 3 is an elevation view illustrating an arrangement of nozzle outlets.
Figure 4:
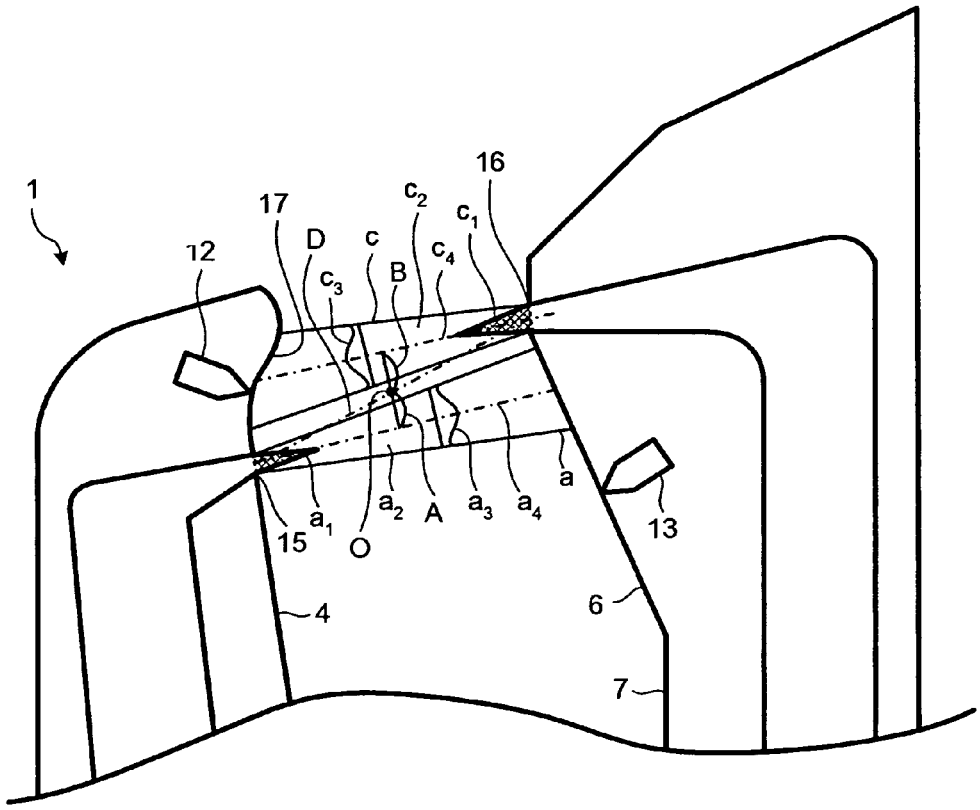
FIG. 4 is a drawing illustrating flow pattern of air jets.
Figure 5:
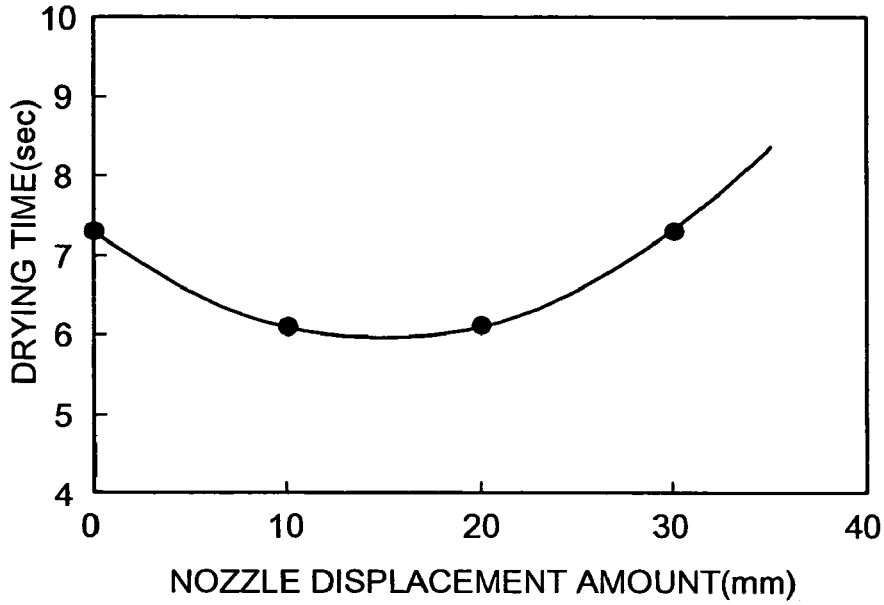
FIG. 5 is a line drawing illustrating a relationship between a nozzle displacement amount and drying time.
Figure 6:
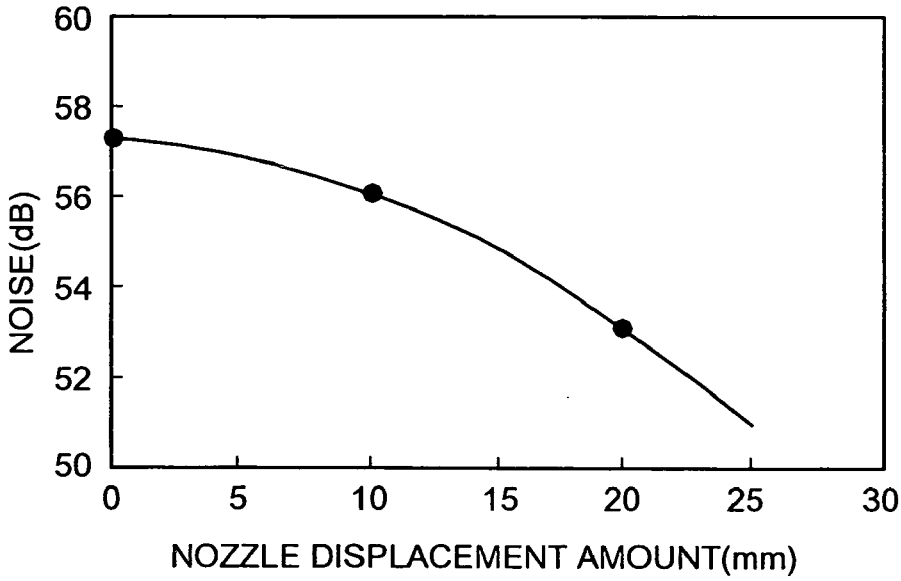
FIG. 6 is a line drawing illustrating a relationship between the nozzle displacement amount and noise.
Figure 7:
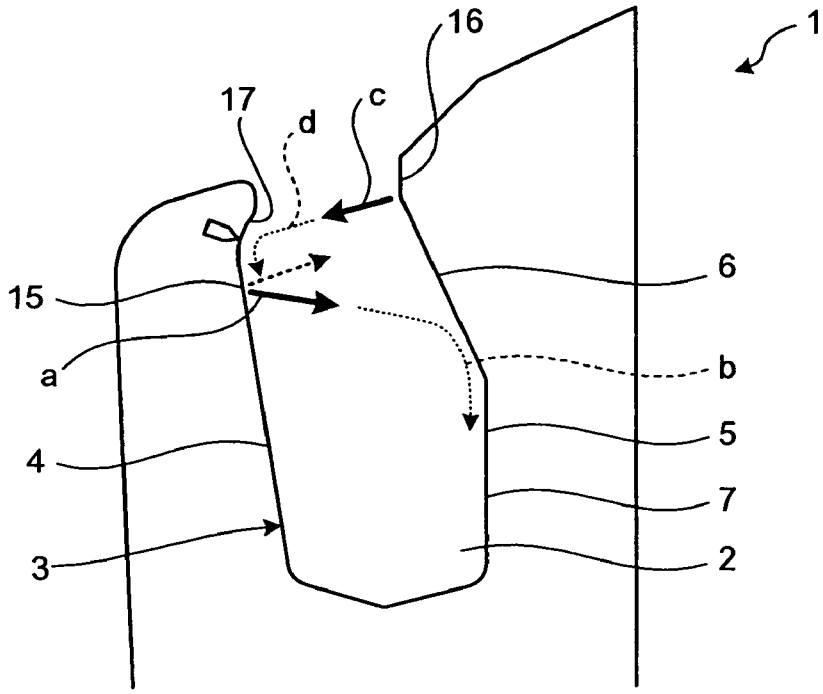
FIG. 7 is a drawing illustrating the action of the air jets.
Figure 13:
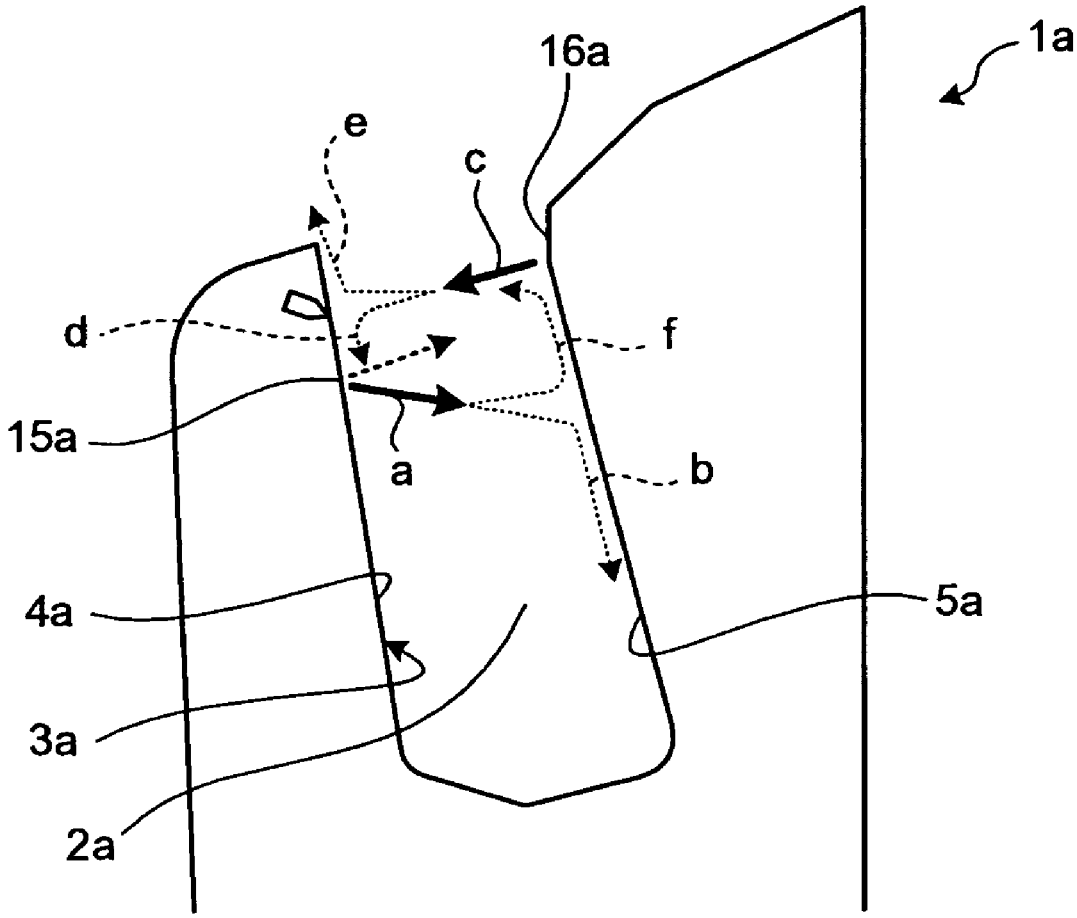
FIG. 13 is a drawing illustrating a comparative example of the first embodiment of the present invention.

FIG. 1 is a vertical section of a hand drying apparatus according to a first embodiment of the present invention. FIG. 2 is a top view of FIG. 1. FIG. 3 is an elevation view illustrating an arrangement of nozzle outlets. FIG. 4 is a drawing illustrating flow pattern of air jets. FIG. 5 is a line drawing illustrating the relationship between a nozzle displacement amount and drying time. FIG. 6 is a line drawing illustrating the relationship between the nozzle displacement amount and noise. FIG. 7 is a drawing illustrating the action of the air jets. FIG. 8 through FIG. 11 are drawings illustrating alternative arrangements of the nozzle outlets. FIG. 13 is a drawing illustrating a comparative example of the first embodiment of the present invention.

As shown in FIG. 1 and FIG. 2, a hand drying apparatus 1, having a substantially vertical shape and that can be wall-mounted with a rear surface 30 against the wall, includes a hand insertion chamber 2. The hand insertion chamber 2 is a substantially U-shaped hollow with an opening at the top and on either side (side openings may not be provided). An inner surface 3 of the hand insertion chamber 2 includes a first inner surface in the form of a front surface 4, a substantially perpendicular inner lower rear surface 7, a second inner surface in the form of an inner upper rear surface 6 that slants towards the interior of the hand insertion chamber 2, and a bottom surface 8 that is bowed in the mid portion.

The mid portion of the bottom surface 8 has a drain hole 9 through which water droplets from the hands is lead to a drainage tank 11 via a drainage pipe 10.

Infrared light emitting units 12 and 14 that detect the presence or absence of hands are respectively provided in the upper portion of the front surface 4 of the hand insertion chamber 2 and at the place where the front surface 4 and the bottom surface 8 of the hand insertion chamber 2 form an angle. The infrared light emitting units 12 and 14 together with an infrared light receiving unit 13 located in the mid portion of the inner upper rear surface 6 detect the presence or absence of a hand.

An air supply duct 18 feeds high-pressure air to the first nozzle 15 and the second nozzle 16. The first nozzle 15 and the second nozzle 16 are described in detail later. The high-pressure air feeding device 19 is connected to the air supply duct 18. An inlet 20 of the high-pressure air feeding device 19 is fitted with a detachable filter 21 that eliminates dust, etc. from the air.

The upper portion of the front surface 4 (the first inner surface) is provided with the first nozzle 15. The first nozzle 15 blows out a first air jet a towards the inner upper rear surface 6 (the second inner surface). The upper portion of the inner upper rear surface 6 (the second inner surface) is provided with the second nozzle 16. The second nozzle 16 blows out a second air jet c towards the front surface 4 (the first inner surface). The positions of the first nozzle 15 and the second nozzle 16 are vertically displaced, the first nozzle 15 being at a lower level (towards the interior of the hand insertion chamber 2) with respect to the second nozzle 16.

As shown in FIG. 3, the first nozzle 15 and the second nozzle 16 each has a plurality of circular outlets 15*a* and 16*a*, respectively, horizontally arranged in a row. As indicated by the arrows in FIG. 1, the axes of the first air jet a and the second air jet c from the first nozzle 15 and the second nozzle 16, respectively, are displaced vertically because of the first nozzle 15 being lower (towards the interior of the hand insertion chamber 2) than the second nozzle 16, so that the first air jet a and the second air jet c do not collide with each other before each hitting the opposite surface.

As shown in FIG. 4, the first air jet a from the first nozzle 15 and the second air jet c from the second nozzle 16 each is in the form of a divergent jet of air. A wedge-shaped potential core $a_1$ and $c_1$ with the sharp end towards the downstream direction is formed at the core around an air jet axis $a_4$ and $c_4$. The velocity of the air jet at the potential core $a_1$ and $c_1$ remains unchanged from the velocity of the air jet at the point of origin. A wide diameter portion $a_2$ and $c_2$ is formed around the potential core $a_1$ and $c_1$ by mingling of the eddying surrounding air. The potential core disappears at a distance that is five times the nozzle opening diameter from the first nozzle 15 and the second nozzle 16. A velocity distribution pattern $a_3$ and $c_3$ in the direction of the diameter of the first air jet a and the second air jet c is in the form of a gently curving mountain with a peak at the core.

The nozzle opening is round and usually of a diameter of 4 mm. The length of the potential cores $a_1$ and $c_1$ are 5×4, that is 20 mm. The distance between the first nozzle 15 and the second nozzle 16 is 80 mm. Consequently, if a displacement amount between the air jet axis $a_4$ and $c_4$ is less and the first air jet a and the second air jet c collide, the velocity distribution pattern at the collision point (at a mid-distance of 40 mm from the first nozzle 15 and the second nozzle 16) is in the form of the gently sloping mountain described above, with a reduced velocity of the air in the surrounding wide diameter portion $a_2$ and $c_2$. Even though the air jet axes $a_4$ and $c_4$ are staggered by a certain displacement amount, mingling of the air in the surrounding wide diameter portions $a_2$ and $c_2$ takes place. However, no noise is produced because of the reduced velocity of the air in the wide diameter portions $a_2$ and $c_2$.

In the present explanation, the displacement amount between the air jet axes $a_4$ and $c_4$ is defined as A+B, as shown in FIG. 4, where A is the length of the perpendicular line dropped to the air jet axis $a_4$ from a midpoint O of a line D joining the first nozzle 15 and the second nozzle 16 and B is the length of the perpendicular line dropped to the air jet axis $c_4$ from the mid point O of the line D joining the first nozzle 15 and the second nozzle 16. The displacement amount between the air jet axes $a_4$ and $c_4$ is also known as "nozzle displacement amount".

As shown in FIG. 1, the inner surface 3 above (towards the opening of the hand insertion chamber 2) the first nozzle 15 with which the second air jet c from the second nozzle 16 collides is in the form of a sloping surface 17, which is a streamlined concave curved surface slanting towards the interior of the hand insertion chamber 2. The second air jet c from the second nozzle 16 collides with the sloping surface 17 and flows downward along the contour of the sloping surface 17 and hits and pushes the first air jet a from the first nozzle 15 downward. Because of the streamlined concave curvature of the sloping surface 17, no noise is produced when the second air jet c collides with the sloping surface 17.

Upon being pushed downward by the second air jet c from the second nozzle 16, the first air jet a from the first nozzle 15 flows downward and away from the second air jet c, colliding with the inner upper rear surface 6, upon which the first air jet a is directed further downward toward the inner lower rear surface 7.

A vertical displacement amount (nozzle displacement amount) of 5 mm to 30 mm is preferable between the air jet axis $a_4$ of the first air jet a and the air jet axis $c_4$ of the second air jet c. As shown in FIG. 5, as the displacement amount (mm) changes, so does the drying time (sec). The drying time 7 sec, 6.5 sec, 6 sec, 6 sec, and 7 sec correspond respectively to the displacement amount of 0 mm, 5 mm, 10 mm, 20 mm, and 30 mm, forming a substantially U-shaped curve. The drying time corresponding to the displacement amount in the range of 3 mm to 30 mm is less than the drying time at a displacement amount of zero (when the jet air axes $a_4$ and $c_4$ collide).

As shown in FIG. 6, when the nozzle displacement amount (mm) is changed in the instance when the first air jet a from the first nozzle 15 is not pushed downward, the noise, in decibels (dB), is 57.5 dB, 57 dB, 56 dB, and 53 dB corresponding respectively to nozzle displacement amounts of 0 mm, 5 mm, 10 mm, and 20 mm, illustrating that the noise is inversely proportional to the nozzle displacement amount.

When the second air jet c pushed down the first air jet a, the vertical displacement amount between the first air jet a from the first nozzle 15 and the second air jet c from the second nozzle 16 increases further, thereby further reducing the noise. Thus, by setting a displacement amount of 5 mm to 30 mm, a good drying efficiency can be obtained and the noise can be effectively reduced.

Additionally, the larger opening diameter is provided for the first nozzle 15, towards which the palms usually face, than the second nozzle 16, towards which the back of the hands face, so that amount of air directed towards the palms is greater.

The functioning of the hand drying apparatus according to the first embodiment is explained next. When wet hands are inserted in the hand insertion chamber 2, the palms are normally directed towards the front, facing the first nozzle 15. A control unit (not shown) activates the infrared light emitting units 12 and 14 and the infrared light receiving unit 13 and detects the hands based on whether infrared light is detected by the infrared light receiving unit 13. When the control unit determines presence of the hands, it activates the high-pressure air feeding device 19. The high-pressure air feeding device 19 takes in the air through the inlet 20. The filter 21 filters out the dust in the air. Dust-free high-pressure air builds up within the high-pressure air feeding device 19.

The dust-free high-pressure air, fed to the first nozzle 15 and the second nozzle 16 through the air supply duct 18, emerge from the first nozzle 15 and the second nozzle 16 in the form of the first air jet a and the second air jet c, respectively, as shown by the arrows in FIG. 1 and FIG. 2, and comes in contact with the hands. The air jet blows the wet hands dry without the user having to rub the hands together. The blowing causes the water droplets from the hands to fall on the inner surface 3 of the hand insertion chamber 2. The collected water droplets then flow through the drain pipe 10 via the drain hole 9 and collect in the drain duct 11. Thus, the area around the hand drying apparatus is kept dry.

When the hands are moved upward while the drying process is going on, as far as the hands are still in the hand insertion chamber 2, the control unit continues to detect the presence of the hands, and the first nozzle 15 and the second nozzle 16 continue to blow respectively the first air jet a and the second air jet c, further blowing off any remaining wetness on the surface of the hands. The hand drying apparatus 1 continues to operate for a short while before shutting down even after the hands are completely removed from the hand insertion chamber 2 and the control unit is no longer able to detect the presence of the hands. The vertically displaced arrangement of the first nozzle 15 and the second nozzle 16 allows the first air jet a and the second air jet b from the respective nozzles to effectively dry both the palms and the backs of the hands.

In the short duration when the hand drying apparatus 1 continues to operate after the hands are completely withdrawn from the hand insertion chamber 2, the noise is subdued as the vertical displacement between the first air jet a from the first nozzle 15 and the second air jet c from the second nozzle 16 is further accentuated due to the former being pushed down by the latter, avoiding direct collision of the first air jet a with the second air jet c.

As shown in FIG. 7 (and FIG. 1), the sloping surface 17, in particular, plays a major role in further widening the vertical displacement between the first air jet a and the second air jet c, by allowing the second air jet b from the second nozzle 16 to flow downward and hit and push down the first air jet a from above, thus further widening the vertical displacement between the first air jet a and the second air jet c.

As the second air jet c from the second nozzle 16 is directed downward by the sloping surface 17, any unpleasant sensation a user may feel due to upward (towards the opening of the hand insertion chamber 2) gust of air is avoided. Also, the slant of the inner upper rear surface 6 towards the bottom (interior) of the hand insertion chamber 2 directs the first air jet a from the first nozzle 15 downward along the inner lower rear surface 7. Consequently, collision of the first air jet a with the second air jet b from the second nozzle 16 is avoided, thereby preventing any noise that may arise due to the collision.

In the comparative example shown in FIG. 13, a front surface 4*a* is a plane surface without the sloping surface 17 shown in FIG. 1 and FIG. 7. In this case, the second air jet c from a second nozzle 16*a* collides with the front surface 4*a* and a splinter air jet e flows upward (towards the opening of the hand insertion chamber 2) along the front surface 4*a*, thus causing an unpleasant sensation to the user.

Further, in the comparative example shown in FIG. 13, the upper rear surface is not slanting towards the bottom (interior) of the hand insertion chamber 2. In this case, the first air jet a from a first nozzle 15*a* collides with a rear surface 5*a*, causing a splinter air jet f to flow upward along the rear surface 5*a* and collide with the second air jet c from the second nozzle 16*a*. This leads to turbulence in the second air jet c. The turbulence spreads to a downward splinter air jet d along the front surface 4*a*, which is transmitted to the first air jet a, which is propagated to the splinter air jet f, which makes the second air jet c further turbulent. The turbulence in the air jet causes a loud pulsating noise.

As the moisture tends to stick faster to the palm of the hand than to the back of the hand due to the anatomy of the hand, uniform drying of the hand can be ensured by allowing more amount of air to be blown from the first nozzle 15 towards which the palms usually face, than from the second nozzle 16. Further, the first nozzle 15 can be provided at a lower level with respect to the second nozzle 16 to enhance the drying efficiency.

Figure 8:
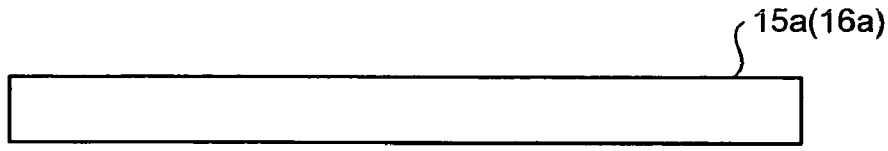
FIG. 8 is a drawing illustrating an alternative arrangement of the nozzle outlets.
Figure 9:
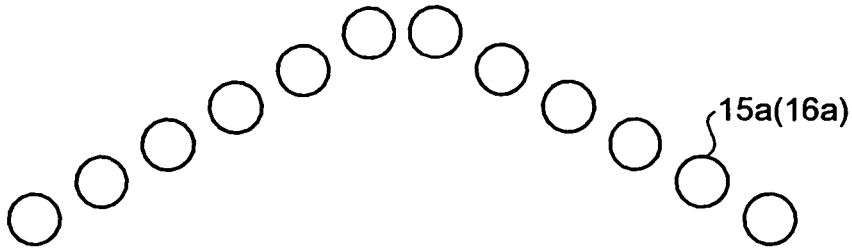
FIG. 9 is a drawing illustrating another alternative arrangement of the nozzle outlets.
Figure 10:
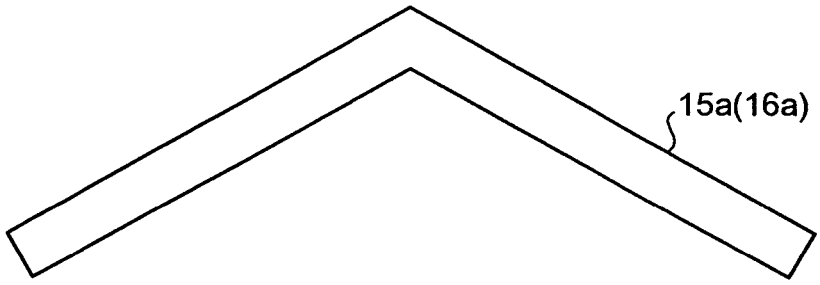
FIG. 10 is a drawing illustrating still another alternative arrangement of the nozzle outlets.
Figure 11:
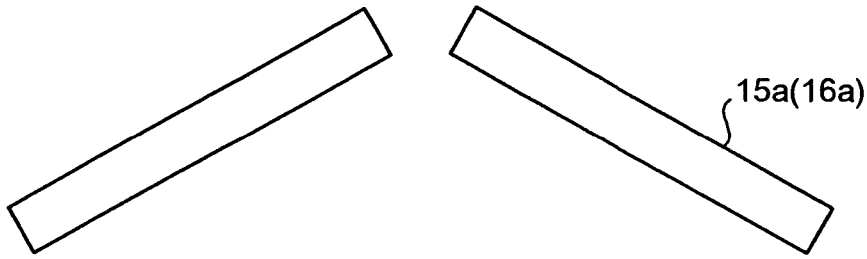
FIG. 11 is a drawing illustrating still another alternative arrangement of the nozzle outlets.

In the aforementioned description, the first nozzle 15 and the second nozzle 16 each has a plurality of circular outlets 15*a* and 16*a*, respectively, horizontally arranged in a row. However, the outlet 15*a* and 15*b* may be in the form of an elongated horizontal slit, as shown in FIG. 8, or a plurality of outlets 15*a* and 16*a* arranged in the shape of a Λ, as shown in FIG. 9, or one outlet 15*a* and 16*a* in the form of a slit shaped like a Λ, as shown in FIG. 10, or two outlets 15*a* and 16*a* in the form of slits arranged in the shape of a Λ, with a gap between the two limbs, as shown in FIG. 11.

The nozzle outlet in the form of a single horizontal slit dries the hands uniformly as there are no gaps in the air jet. The nozzle outlet shaped like a Λ dries the hands efficiently as the outlet is orthogonal to the hands inserted into the hand insertion chamber 2 at an angle from either direction. The nozzle outlet in the form of a Λ with a gap between the two limbs enhances energy efficiency of the hand drying apparatus 1 as no air is blown in the mid portion where generally neither hand reaches.

In the aforementioned description, the first air jet a from the first nozzle 15 and the second air jet c from the second nozzle 16 are substantially parallel to each other so as not to collide with each other before hitting the opposite wall and cause noise. The first nozzle 15 and the second nozzle 16 may be oriented so that the first air jet a and the second air jet c are at directed away from-each other so as not to collide with each other before hitting the opposite wall.

The second nozzle 16 may be at a lower level (towards the interior of the hand insertion chamber 2) with respect to the first nozzle 15. In that case, the inner surface 3 above the second nozzle 16 on which the first air jet a from the first nozzle 15 will collide may slant towards the interior of the hand insertion chamber 2 such that the first air jet a from the first nozzle 15, upon hitting the inner surface 3, flows downward along the slanting surface and hits and the second air jet c from the second nozzle 16 and pushes it downward.

Second Embodiment

Figure 12:
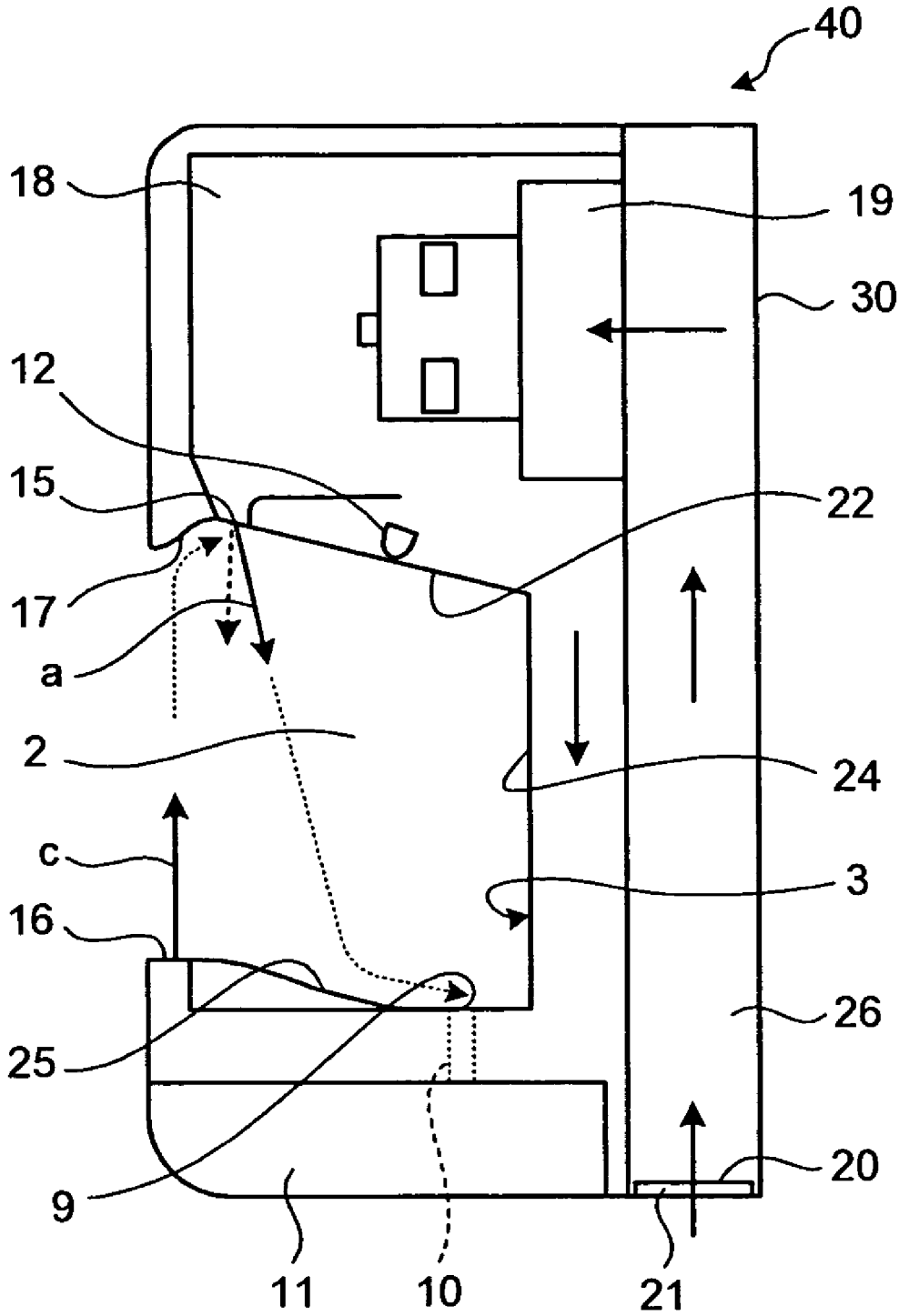
FIG. 12 is a vertical section of the hand drying apparatus according to a second embodiment of the present invention.

FIG. 12 is a vertical section of a hand drying apparatus 40 according to a second embodiment of the present invention. The parts in FIG. 12 that are identical to those in FIG. 1 are assigned the same reference numeral.

As shown in FIG. 12, the hand drying apparatus 40, having a substantially vertical shape and that can be wall-mounted with the rear surface 30 against the wall, includes the hand insertion chamber 2. The hand insertion chamber 2 is a substantially ⊃-shaped hollow with an opening at the top and on either side (side openings may not be provided). An inner surface 3 of the hand insertion chamber 2 includes a second inner surface forming an upper surface 22, a substantially perpendicular rear surface 24, and a first inner surface forming a bottom surface 25. The upper surface 22 slants upward towards the opening (towards the front) of the hand insertion chamber 2. The bottom surface 25 has a slant, making a portion (the rear portion) lower than the remaining bottom surface 25.

The low rear portion of the bottom surface 25 has the drain hole 9 through which water droplets from the hands is lead to the drainage tank 11 via the drainage pipe 10.

The infrared light emitting unit 12 is provided in the mid portion of the upper surface 22. An infrared light receiving unit (not shown) is located in the inner surface 3 opposite to the upper surface 22 and it is configured to receive the infrared light radiated from the infrared light emitting unit 12. If a hand is positioned between the infrared light emitting unit 12 and the infrared light receiving unit, infrared lights emitted from the infrared light emitting unit 12 does not reach the infrared light receiving unit, so that the hand can be detected.

The air supply duct 18 feeds air at high pressure to a first nozzle 15 and a second nozzle 16. The first nozzle 15 and the second nozzle 16 are described in detail later. The high-pressure air feeding device 19 is provided inside the air supply duct 18. The air supply duct 18 feeds air from the high-pressure air feeding device 19 to the first nozzle 15 and the second nozzle 16. The rear portion of the air feeding duct 18 is provided with an inlet duct 26. The inlet 20 disposed at the bottom of the inlet duct 26 is fitted with the detachable filter 21 that eliminates dust, etc. from the air.

The first nozzle 15 is located on the upper surface 22 (the first inner surface) at the opening end (front) of the hand insertion chamber 2. The first nozzle 15 blows the first air jet a towards the bottom surface 25 (the second inner surface). The second nozzle 16 is located on the bottom surface (the second inner surface) at the opening end (front). The second nozzle 16 blows the second air jet c towards the upper surface 22 (the first inner surface). The locations of the first nozzle 15 and the second nozzle 16 are displaced antero-posteriorly such that the first nozzle 15 is more towards the rear (the interior of the hand insertion chamber 2) than the second nozzle 16.

As shown in FIG. 3, the first nozzle 15 and the second nozzle 16 each has a plurality of circular outlets 15*a* and 16*a*, respectively, horizontally arranged in a row. As indicated by the arrows in FIG. 1, the axes of the first air jet a and the second air jet c from the first nozzle 15 and the second nozzle 16, respectively, are displaced antero-posteriorly because of the first nozzle 15 being posteriorly situated (towards the interior of the hand insertion chamber 2) than the second nozzle 16, so that the first air jet a and the second air jet c do not collide with each other before each hitting the opposite surface. The second nozzle 16 blows more amount of air than the first nozzle 15.

The upper surface 22 towards the opening of the hand insertion chamber 2 (towards the front) from the first nozzle 15 with which the second air jet c from the second nozzle 16 collides is in the form of the sloping surface 17, which is a streamlined concave curved surface slanting towards the interior (towards the back) of the hand insertion chamber 2. The second air jet c from the second nozzle 16 collides with the sloping surface 17 and flows backward along the contour of the sloping surface 17 and hits and pushes the first air jet a from the first nozzle 15 downward. Because of the streamlined concave curvature of the sloping surface 17, no noise is produced when the second air jet c collides with the sloping surface 17.

Upon being pushed downward by the second air jet c from the second nozzle 16, the first air jet a from the first nozzle 15 flows towards the back, colliding with the bottom surface 25, upon which the first air jet a is directed further towards the back. A vertical displacement amount of 5 mm to 30 mm is preferable between the air jet axis of the first air jet a and the air jet axis of the second air jet c.

The functioning of the hand drying apparatus 40 according to the second embodiment is explained next. When wet hands are inserted in the hand insertion chamber 2, the palms are normally directed towards the bottom, facing the second nozzle 16. A control unit (not shown) activates the infrared light emitting unit 12 and the infrared light receiving unit and detects the hands based on whether infrared light is detected by the infrared light receiving unit. The high-pressure air feeding device 19 takes in the air through the inlet 20. The filter 21 filters out the dust in the air. Dust-free high-pressure air builds up within the high-pressure air feeding device 19.

The dust-free high-pressure air, fed to the first nozzle 15 and the second nozzle 16 through the air supply duct 18, emerge from the first nozzle 15 and the second nozzle 16 in the form of the first air jet a and the second air jet c, respectively, as shown by the arrows in FIG. 12, and comes in contact with the hands. The air jet blows the wet hands dry without the user having to rub the hands together. The blowing causes the water droplets from the hands to fall on the inner surface 3 of the hand insertion chamber 2. The collected water droplets then flow through the drain pipe 10 via the drain hole 9 and collect in the drain duct 11. Thus, the area around the hand drying apparatus 40 is kept dry.

Although the hands are withdraw by pulling the hands back towards the front of the hand insertion chamber 2, as far as the hands are still in the hand insertion chamber 2, the control unit continues to detect the presence of the hands, and the first nozzle 15 and the second nozzle 16 continue to blow respectively the first air jet a and the second air jet c, further blowing off any remaining wetness on the surface of the hands. the hand drying apparatus 40 continues to operate for a short while before shutting down even after the hands are completely removed from the hand insertion chamber 2 and the control unit is no longer able to detect the presence of the hands. The antero-posteriorly displaced arrangement of the first nozzle 15 and the second nozzle 16 allows the first air jet a and the second air jet b from the respective nozzles to effectively dry both the palms and the backs of the hands.

In the short duration when the hand drying apparatus 40 continues to operate after the hands are completely withdrawn from the hand insertion chamber 2, the noise is subdued as the antero-posterior displacement between the first air jet a from the first nozzle 15 and the second air jet c from the second nozzle 16 is further accentuated due to the latter being pushed more towards the back by the former, avoiding direct collision of the second air jet b with the first air jet a.

As the second air jet c from the second nozzle 16 is directed towards the back by the sloping surface 17, any unpleasant sensation a user may feel due to forward (towards the opening of the hand insertion chamber 2) gust of air is avoided. Also, the slant on the bottom surface 25 towards the back (interior) of the hand insertion chamber 2 directs the first air jet a from the first nozzle 15 towards the back of the hand insertion chamber 2. Consequently, collision of the first air jet a with the second air jet b from the second nozzle 16 is avoided, thereby preventing any noise that may arise due to the collision.

As the moisture tends to stick faster to the palm of the hand than to the back of the hand due to the anatomy of the hand, uniform drying of the hand can be ensured by allowing more amount of air to be blown from the second nozzle 16 towards which the palms usually face, than from the first nozzle 15. Further, the first nozzle 15 can be provided more towards the back (towards the interior) than the second nozzle 16 to enhance the drying efficiency.

In the aforementioned description, the first nozzle 15 and the second nozzle 16 each has a plurality of circular outlets 15*a* and 16*a*, respectively, horizontally arranged in a row. However, the outlet 15*a* and 16*a* may be in the form of an elongated horizontal slit, as shown in FIG. 8, or a plurality of outlets 15*a* and 16*a* arranged in the shape of a Λ, as shown in FIG. 9, or one outlet 15*a* and 16*a* in the form of a slit shaped like a Λ, as shown in FIG. 10, or two outlets 15*a* and 16*a* in the form of slits arranged in the shape a Λ, with a gap between the two limbs, as shown in FIG. 11.

In the aforementioned description, the first air jet a from the first nozzle 15 and the second air jet c from the second nozzle 16 are substantially parallel to each other so as not to collide with each other before hitting the opposite wall and cause noise. The first nozzle 15 and the second nozzle 16 may be oriented so that the first air jet a and the second air jet c are directed away from each other so as not to collide with each other before hitting the opposite wall.

The second nozzle 16 may be towards the back (towards the interior of the hand insertion chamber 2) with respect to the first nozzle 15. In that case, the inner surface 3 towards the front (towards the opening of the hand insertion chamber 2) of the second nozzle 16 on which the first air jet a from the first nozzle 15 will collide may slant towards the interior of the hand insertion chamber 2 such that the first air jet a from the first nozzle 15, upon hitting the inner surface 3, flows backward along the slanting surface and hits the second air jet c from the second nozzle 16 and pushes it towards the interior.

INDUSTRIAL APPLICABILITY

The hand drying apparatus according to the present invention is efficient and produces less noise, making it ideal for installing at public facilities.

The invention claimed is:

1. A hand drying apparatus comprising:

a hand insertion chamber having, a hollow portion and an opening for inserting a wet hand in the hollow portion, the hollow portion being defined by a first inner surface and a second inner surface substantially opposing the first inner surface;

a first air opening arranged on the first inner surface and configured to blow a first air jet towards the second inner surface; and a second air opening arranged on the second inner surface and configured to blow a second air jet toward the first inner surface, wherein the first air opening is arranged at an interior side of the hollow portion with respect to the second air opening such that axes of the first air jet and the second air jet do not collide, and a portion of the first inner surface, between the opening of the hollow portion and the first air opening, that receives the second air jet from the second air opening is inclined toward the interior of the hollow portion in order to flow the second air jet from the opening to the interior side of the hollow portion and distance the first air jet from the second air jet.

2. The hand drying apparatus according to claim 1, wherein the portion of the first inner surface that receives the second air jet forms a streamlined concave curved surface.

3. The hand drying apparatus according to claim 1, wherein a portion of the second inner surface that receives the first air jet from the first air opening is inclined toward the interior of the hollow portion.

4. The hand drying apparatus according to claim 1, wherein a displacement between the axes of the first air jet axis and the second air jet axis is 5 mm to 30 mm.

5. The hand drying apparatus according to claim 1, wherein the first air opening and the second air opening are oriented such that axes of the first air jet axis and the second air jet are any one of parallel and diverge from each other.

6. The hand drying apparatus according to claim 1, wherein the first air opening includes an array of air outlets and the second air opening includes an array of air outlets.

7. The hand drying apparatus according to claim 1, wherein the first air opening and the second air opening are integrated into one elongated slit as an air outlet.

8. The hand drying apparatus according to claim 1, wherein the first air opening includes an array of air outlets, the second air opening includes an array of air outlets, and the first air opening and the second air opening are arranged in the shape of the letter v.

9. The hand drying apparatus according to claim 1, wherein the first air opening includes a first elongated slit as an air outlet, the second air opening includes a second elongated slit as an air outlet, and the first elongated slit and the second elongated slit are arranged in the shape of the letter v, with a gap between two limbs of the letter.

10. The hand drying apparatus according to claim 1, wherein among the first air opening and the second air opening, the one that faces the palms of the hand blows more amount of air.

* * * * *